US010625169B1

(12) United States Patent
Mayer

(10) Patent No.: US 10,625,169 B1
(45) Date of Patent: Apr. 21, 2020

(54) STANDING PLAYGROUND GLIDER

(71) Applicant: BCI Burke Company, LLC, Fond du Lac, WI (US)

(72) Inventor: Bart Mayer, Fond du Lac, WI (US)

(73) Assignee: BCI Burke Company, LLC, Fond du Lac, WI (US)

( * ) Notice: Subject to any disclaimer, the term of this patent is extended or adjusted under 35 U.S.C. 154(b) by 0 days.

(21) Appl. No.: 16/280,580

(22) Filed: Feb. 20, 2019

Related U.S. Application Data

(60) Provisional application No. 62/789,078, filed on Jan. 7, 2019.

(51) Int. Cl.
*A63G 9/02* (2006.01)
*A63G 9/12* (2006.01)

(52) U.S. Cl.
CPC ..... *A63G 9/02* (2013.01); *A63G 9/12* (2013.01); *A63B 2208/12* (2013.01)

(58) Field of Classification Search
CPC ... A63G 9/00; A63G 9/02; A63G 9/12; A47D 13/105; A47D 13/107
USPC ..... 472/118, 120–125
See application file for complete search history.

(56) References Cited

U.S. PATENT DOCUMENTS

| | | | | |
|---|---|---|---|---|
| 5,393,268 | A * | 2/1995 | Cunard | A63G 9/20 472/118 |
| 6,932,710 | B1 | 8/2005 | Hartin | |
| 7,892,151 | B2 | 2/2011 | Colk et al. | |
| 9,833,680 | B2 | 12/2017 | Claustre et al. | |
| D810,853 | S | 2/2018 | Bertschy | |
| 2011/0263344 | A1* | 10/2011 | Brown | A63G 9/00 472/118 |

* cited by examiner

*Primary Examiner* — Kien T Nguyen
(74) *Attorney, Agent, or Firm* — Boyle Fredrickson S.C.

(57) ABSTRACT

A playground glider swing is provided that allow one or more users to glide while standing on a rigid board and while grasping a rigid crossbar to assist with creating opposite momentum between the crossbar and the board. The users may stand on opposite ends of the crossbar to provide back and forth movement in a gliding motion. In this respect the present invention may be safely used by one or more children in a playground environment.

20 Claims, 6 Drawing Sheets

STANDING PLAYGROUND GLIDER

CROSS-REFERENCE TO RELATED APPLICATIONS

This application claims the benefit of U.S. Provisional Application No. 62/789,078, filed Jan. 7, 2019, and hereby incorporated by reference.

BACKGROUND OF THE INVENTION

The present invention relates to playground swing sets and glider swings, and in particular, to a glider swing which may be used while the user or users are standing.

Generally, swing sets are hanging seats suspended from an upper frame. The seat of a swing is typically suspended from chains or ropes. A glider swing is a type of swing set where the hanging seat is connected at four points on the seat.

Playground swing sets and glider swings are typically used with the user in a seated position. Some modified swing sets and glider swings are used with the user standing on a board, for example, as training or simulation devices for board sports such as skateboarding, surfing, windsurfing, kite boarding, wake boarding and the like. Typically, in the training or simulation of these sports, the user is provided with a hand bar hung from above or two lateral side handlebars at opposed ends of the board. These standing swing sets and glider swings are typically ridden by a single user.

SUMMARY OF THE INVENTION

The present invention is provided to allow one or more users to swing or glide while standing on a substantially rigid board and while grasping a substantially rigid crossbar extending over the board to assist with creating opposite momentum between the crossbar and the board. The users may stand on opposite ends of the crossbar to provide back and forth movement in a swinging gliding motion. In this respect the present invention may be safely used by one or more children in a playground environment.

One embodiment of the present invention may provide a glider swing assembly including a support frame adapted to support above a ground surface a first set of longitudinally spaced support frame pivot points laterally separated from a second set of longitudinally spaced support frame pivot points; a platform having a length extending along a longitudinal axis and a width extending along a transverse axis, the platform providing on its upper surface a first set of longitudinally spaced platform pivot points laterally separated from a second set of longitudinally spaced platform pivot points; a set of at least four flexible suspension members attached individually to each of the first and second set of longitudinally spaced support pivot points and connecting to a corresponding one of the first and second set of longitudinally spaced platform pivot points to suspend the platform above the ground to swing along the longitudinal axis; and a first and second longitudinal side bars extending along the longitudinal axis to connect to respective flexible suspension members of sets of longitudinally spaced pivot points, respectively, at a height between the support frame and the platform to provide handgrips for a user standing on the platform wherein the flexible suspension members allow the platform and the first and second longitudinal side bars, respectively, to move relative to each other in opposing directions to promote overall swinging motion of the entire assembly.

It is thus a feature of at least one embodiment of the invention to provide a dual rider standing glider swing which allows opposite directional motion of the handlebar and board to propel swinging motion.

A transverse spacer bar may extend between the first and second longitudinal side bars.

It is thus a feature of at least one embodiment of the invention to provide connection of all four support chains to a single handlebar so that coordinated parallel movement of all four chains (i.e., four chain linkage) may allow for gliding motion along a longitudinal axes without twisting motion.

The transverse spacer bar may extend across center portions of the first and second longitudinal side bars to provide an H configuration.

It is thus a feature of at least one embodiment of the invention to allow the two users to stand between the longitudinal side bars on opposite sides of the transverse spacer bar.

The first and second longitudinal side bars may extend substantially a full length of the board and the transverse spacer bar may extend substantially a full width of the board.

It is thus a feature of at least one embodiment of the invention to provide attachment of the four chains at edges of the co-extensive handlebar whereby the area of the board is optimized.

The transverse separation of the first and second longitudinally spaced support pivot points may be greater than a transverse separation of the first and second longitudinally spaced platform pivot points by at least three times.

It is thus a feature of at least one embodiment of the invention to provide swinging movement along a substantially upwardly concave arch and preventing the tipping of the board at its ends along the arch.

The longitudinal separation of the first and second longitudinally spaced support pivot points may be less than the longitudinal separation of the first and second longitudinally spaced platform pivot points.

It is thus a feature of at least one embodiment of the invention to provide preferential swinging motion along the board's longitudinal axis.

The first and second longitudinal side bars may be connected to the flexible suspension members at a height between 2 to 3 feet above the platform.

It is thus a feature of at least one embodiment of the invention to facilitate pushing and pulling of the handgrips along the longitudinal axis by placement of the sidebars proximate the user's arms and hands.

The board may provide an oblong shaped board with a narrowed center.

It is thus a feature of at least one embodiment of the invention to provide weighted outer ends with a lightweight center area facilitating swinging momentum along the longitudinal axes.

The length of the board may be greater than the width of the board by at least three times.

It is thus a feature of at least one embodiment of the invention to allow for more than one user to stand on opposing sides of the board, for example one to four users.

The flexible suspension members may have a length to suspend the board at rest at least 1 foot above the ground surface.

It is thus a feature of at least one embodiment of the invention to place the board close to the ground to facilitate mounting and unmounting of users onto the board.

The board may comprise of a polymer shell reinforced by a metal frame extending along the longitudinal axis.

It is thus a feature of at least one embodiment of the invention to eliminate bending of the board under the weight of users are standing thereon.

The support frame may provide two longitudinally separated arches extending transversely and joined by at least one longitudinally extending beam.

It is thus a feature of at least one embodiment of the invention to provide balanced support for the support frame pivot points during swinging motion of the glider.

The support frame pivot points may provide a swivel that swivel the flexible suspension members in two perpendicular directions.

It is thus a feature of at least one embodiment of the invention to allow swinging of the glider in both longitudinal and transverse directions.

Another embodiment of the present invention may provide a glider swing assembly including a support frame adapted to support above a ground surface, a first set of longitudinally spaced support frame pivot points laterally separated from a second set of longitudinally spaced support frame pivot points; a platform having a length extending along a longitudinal axis and a width extending along a transverse axis, the platform providing on its upper surface a first set of longitudinally spaced platform pivot points laterally separated from a second set of longitudinally spaced platform pivot points; a set of at least four flexible suspension members attached individually to each of the first and second set of longitudinally spaced support pivot points and connecting to a corresponding one of the first and second set of longitudinally spaced platform pivot points to suspend the platform above the ground to swing along the longitudinal axis; where the length of the board is greater than the width of the board by at least three times and where the board comprises a polymer shell reinforced by a metal frame extending along the longitudinal axis.

It is thus a feature of at least one embodiment of the invention to provide a lightweight and broad surfaced board that is able to support multiple users standing thereon.

The metal frame may include at least one rod attached to a bottom surface of the board.

It is thus a feature of at least one embodiment of the invention to provide a substantially rigid board that is easy to construct.

The bottom surface of the board may carry a recess configured to receive the metal frame.

It is thus a feature of at least one embodiment of the invention to provide a flush bottom surface so that the board doesn't contact the ground.

These particular objects and advantages may apply to only some embodiments falling within the claims and thus do not define the scope of the invention.

DETAILED DESCRIPTION OF THE INVENTION

Figure 1:
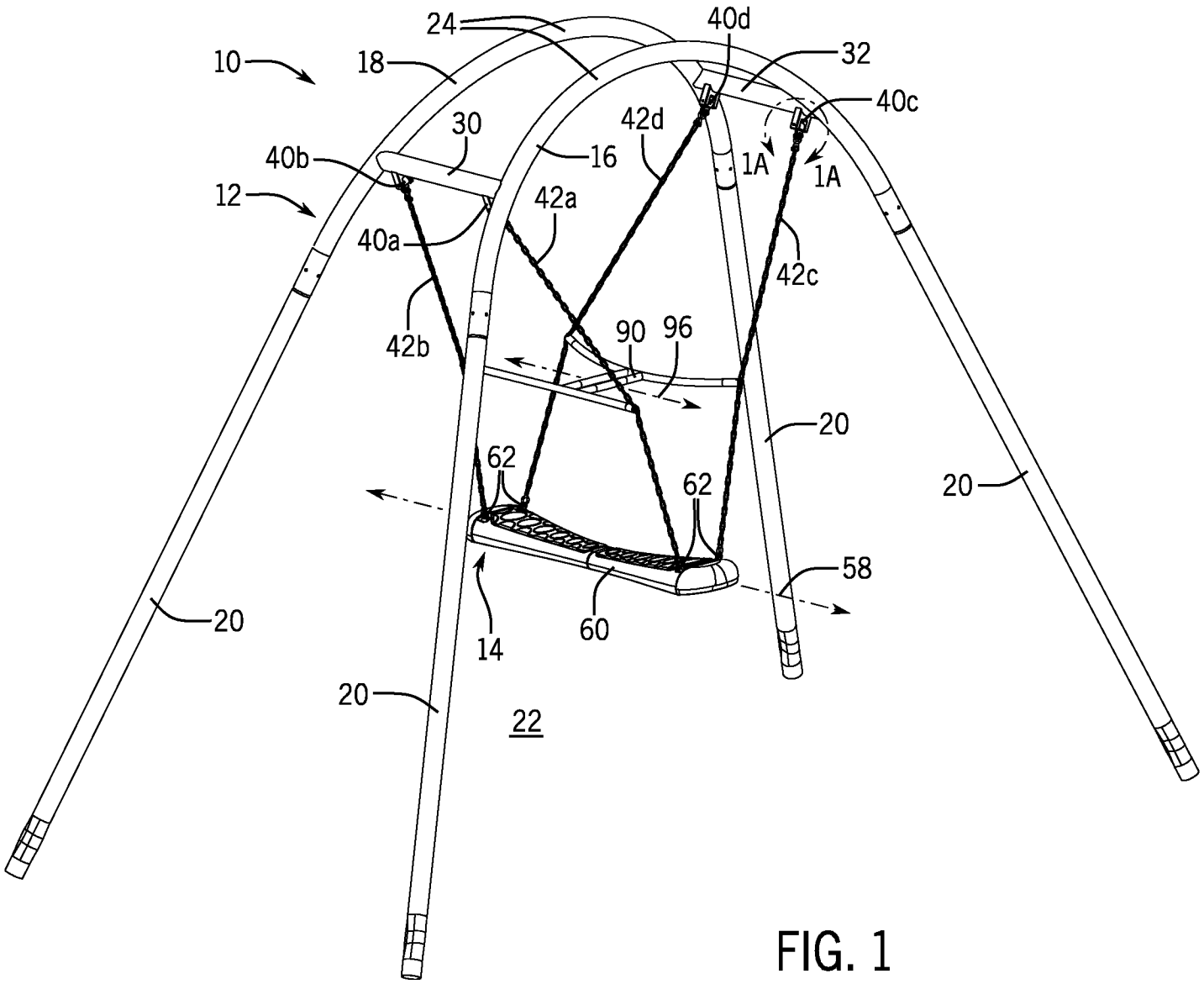
FIG. 1 is a perspective view of a standing playground glider swing assembly of a first embodiment of the present invention showing a glider swing attached to and suspended from a glider swing frame at four attachment points, FIG. 1A showing an enlarged portion of FIG. 1.
Figure 2:
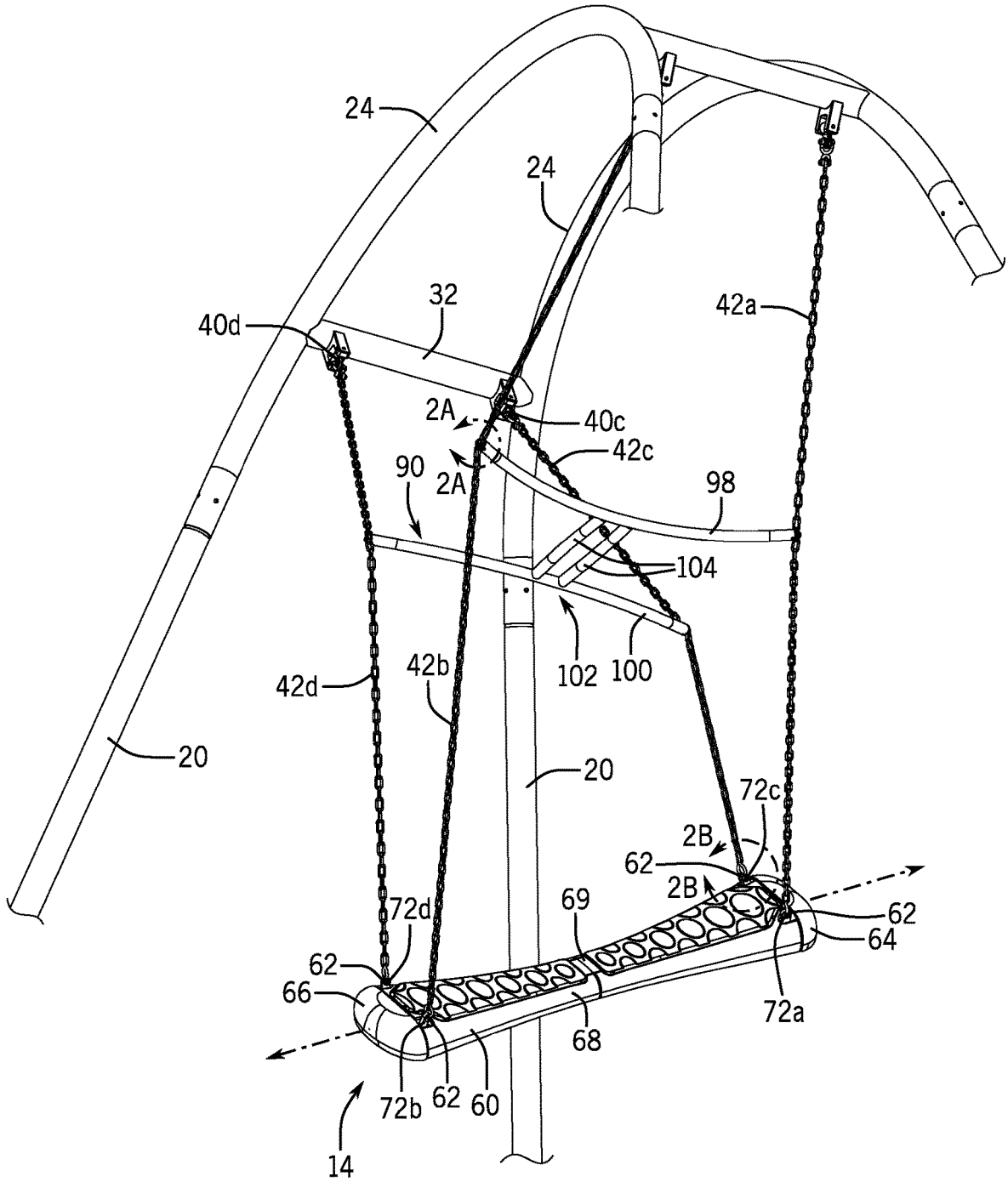
FIG. 2 is a perspective view of the standing playground glider swing assembly of FIG. 1 taken from below showing a footboard supported by glider swing chains at four attachment points and a crossbar extending above the footboard and attached to the glider swing chains at four attachment points, FIGS. 2A and 2B showing enlarged portions of FIG. 2.

Referring to FIGS. 1 and 2, a standing playground glider swing assembly 10 according to one embodiment of the present invention may provide a glider swing frame 12 providing attachment of a glider swing 14. The glider swing frame 12 may comprise of front and rear arches 16, 18 spaced longitudinally in forward and rearward separation and connected at an upper end.

Each of the front and rear arches 16, 18 may be generally described as an inverted U-shaped frame. Each of the front and rear arches 16, 18 may have two opposed vertically extending legs 20 extending upward from a ground 22 and converging to an arched apex 24 curved at a top end of each arch. The two opposed vertically extending legs 20 may angled inwardly toward the arched apex 24. In one embodiment, the vertically extending legs 20 may be angled at an approximately 45° angle upward and inward toward the arched apex 24.

As best seen in FIG. 2, the arched apex 24 of the front and rear arch 16, 18 may be angled toward each other to a top end, while the pair of vertically extending legs 20 of the front and rear arch 16, 18 may be angled away from each other at a bottom end. In one embodiment, the vertically extending legs 20 may be angled at an approximately 45° angle forward and rearward, respectively.

The front and rear arches 16, 18 are connected at an upper end of the vertically extending legs 20 by crossbars 30, 32 extending longitudinally and connecting the front and rear arches 16, 18 at left and right sides, respectively. In one embodiment, the crossbars 30, 32 may be approximately 28 inches in length spanning a distance between the front and rear arches 16, 18.

In one embodiment, the glider swing frame 12 may be approximately 185 inches in length, 92 inches in height, and 86 inches in depth. It is understood that in some embodiments, the vertically extending legs 20 may extend into and below the ground 22, for example, approximately 26 inches below the ground 22, to provide additional anchoring of the glider swing frame 12.

Each of the crossbars 30, 32 may support two longitudinally spaced glider swing hangers 40 allowing for downward connection of glider swing chains 42, for example, four chains 42*a*, 42*b*, 42*c*, 42*d*. Each glider swing hanger 40 may comprise of a pivot assembly providing swiveling movement of the glider swing chains 42 in two perpendicular directions. It is understood that the chains 42 may be any type of flexible suspension members, such as ropes, cables or other flexible strength material(s) formed into a length of material(s) for suspending, hanging and/or supporting weight.

Figure 1A:
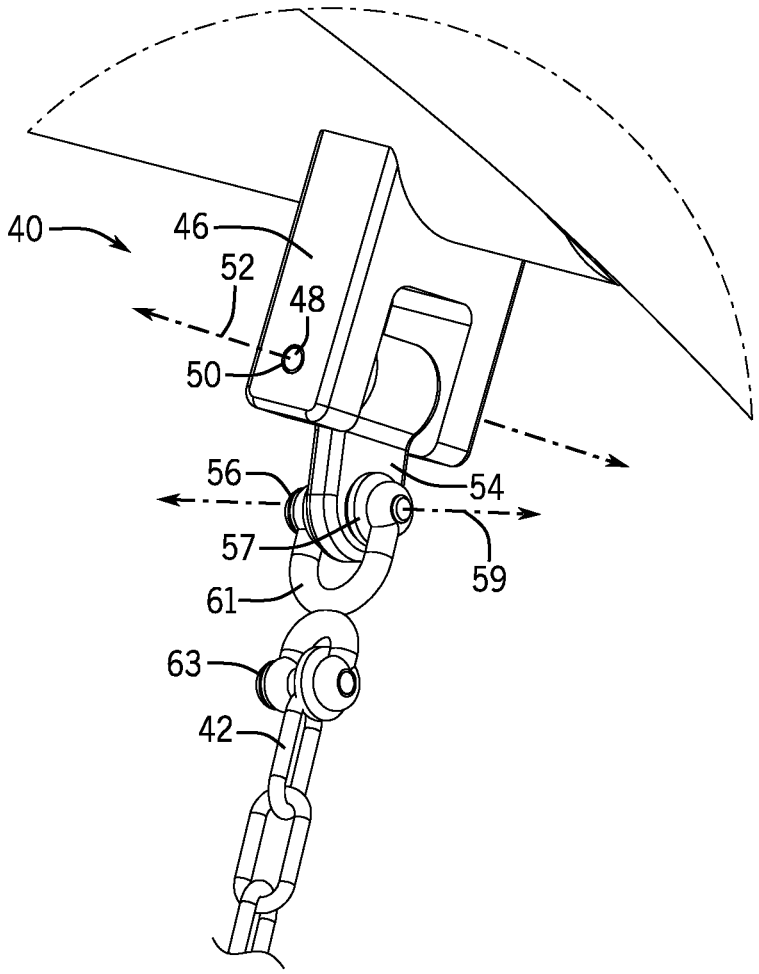

As seen in FIG. 1A, a first pivot member 46 provides an extension of a first pin 48 through opening(s) 50 and allowing for rotary movement about an axis 52 of the first pin 48 extending parallel to the crossbars 30, 32.

The first pin 48 of the first pivot member 46 may support a second pivot member 54 receiving the first pin 48 at a top end and further providing extension of a second pin 56 through an opening 57 extending perpendicular to the opening 50. The second pin 56 provides rotary movement about an axis 59 of the second pin 56 perpendicular to the crossbars 30, 32 at a bottom end of the second pivot member 54.

In this respect, the first pivot member 46 and second pivot member 54 cooperate to provide swiveling movement of the glider swing chains 42 along perpendicular axes 52, 59. It is understood that spacers or washers may be installed between the pivot members 46, 54 and pins 48, 56 in order to distribute pressure and provide a smooth surface against a tightened pin as understood in the art.

The second pin 56 of the second pivot member 54 may further carry an H-shaped shackle 61 supporting parallel pins. The H-shaped shackle 61 is carried by the second pin 56 of the second pivot member 54 on a top end and receiving an uppermost chain link of the glider swing chain 42 through a third pin 63 on a bottom end extending substantially parallel to the second pin 56.

The glider swing hangers 40 may be positioned on longitudinally spaced front and rear ends of each of the crossbars 30, 32. The crossbar 30 may support two longitudinally spaced glider swing hangers 40*a*, 40*b*, and crossbar 32 may support two longitudinally spaced glider swing hangers 40*c*, 40*d*.

In one embodiment, a longitudinal distance between swing hangers 40*a*, 40*b*, and swing hangers 40*c*, 40*d*, respectively, may be approximately 22 inches. A transverse distance between swing hangers 40*a*, 40*c*, and swing hangers 40*b*, 40*d*, respectively, may be approximately 77 inches.

The glider swing hangers 40*a*, 40*b* of the left crossbar 30 may support opposed front and back chains 42*a*, 42*b*, respectively, where chain 42*a* is proximate the front arch 16 and chain 42*b* is proximate the rear arch 18. The glider swing hangers 40*c*, 40*d* of the right crossbar 32 may support opposed front and back chains 42*c*, 42*d*, where chain 42*c* is proximate the front arch 16 and chain 42*d* is proximate the rear arch 18.

The glider swing chains 42 hang therebelow and support the glider swing 14 above the ground 22, as further described below. The glider swing chains 42 may be comprised of metal, for example, steel chains, coated with vinyl or polyvinyl chloride (PVC).

Figure 3:
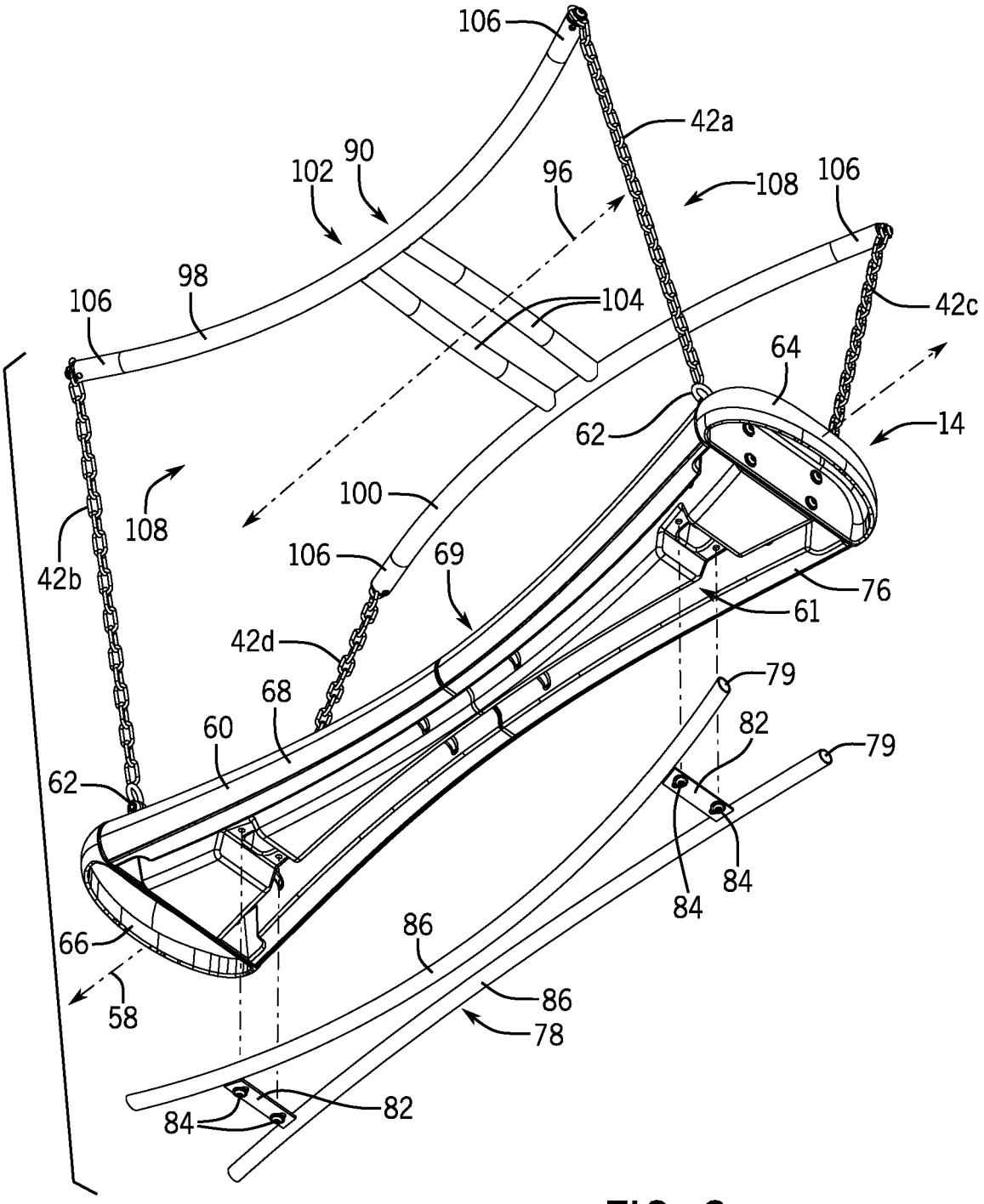
FIG. 3 is a partially exploded, perspective view of a bottom of the glider swing of FIG. 1 taken from below showing an outer plastic mold supporting an inner support skeleton.

Referring also to FIG. 3, the glider swing 14 is suspended by the glider swing chains 42. The glider swing 14 may include a generally rectangular footboard 60 having a dimension of greatest length extending along a longitudinal axis 58 parallel to the ground. The footboard 60 may be elevated above the ground 22, for example, between 1 to 2 feet.

The footboard 60 may take an oblong shape resembling a surfboard or longboard having an upper surface 69 supporting standing user(s) thereon opposite a lower surface 80. The footboard may have longitudinally separated, front and rear ends 64, 66, respectively. The outer front and rear ends 64, 66 may be a separate rubber material or may include a rubber covering providing protective bumpers and rounded outer edges. The footboard 60 may also take an hour-glass shape with a narrowed center area 68 to reduce a weight of the footboard 60 toward its center.

The footboard 60 may be manufactured of a polymer or plastic mold 76, for example by rotomolding in polypropylene or polyvinyl chloride, and may support a support skeleton 78. The lower surface 80 of the footboard 60 may include recesses 61 extending generally along the longitudinal axis 58 of the footboard 60, and supporting the inner skeleton 78 therein. The recesses 61 may correspond to the shape of the footboard 60.

The inner skeleton 78 may comprise of a pair of steel or metal beams 86 extending longitudinally within the recesses 61. The pair of metal beams 86 may converge inward to resemble the shape of the narrowed center area 68 of the footboard 60 and the correspondingly shaped recesses 61. The outer ends of the pair of metal beams 86 may be connected by rungs 82 providing holes 84 therethrough for attachment of the inner skeleton 78 to the outer plastic mold 76 by screws. The pair of metal beams 86 may also be attached to the outer plastic mold 76 by screws extending into endcaps 79 of the pair of metal beams 86 or through holes of the pair of metal beams 86 themselves.

The inner skeleton 78 provides rigid support to the outer plastic mold 76 against bending, especially toward the center area 68 of the footboard 60 most vulnerable to bending. In this respect, the footboard 60 is constructed of a lightweight polymer material that may be easily swung but also maintains rigidity in a direction perpendicular to the longitudinal axis 58 of the footboard 60 against bending when one or more users are standing on the footboard 60.

The footboard may include upwardly extending chain attachments 72*a*, 72*b*, 72*c*, 72*d* at transversely separated corners of the front and rear ends 64, 66, respectively, each supporting an attachment hole 73. The glider swing chains 42*a*, 42*c* proximate the front arch 16 may be connected to transversely separated corners of the front end 64, and chains 42*b*, 42*d* may be connected to transversely separated corners of the rear end 66, respectively.

Figure 2A:
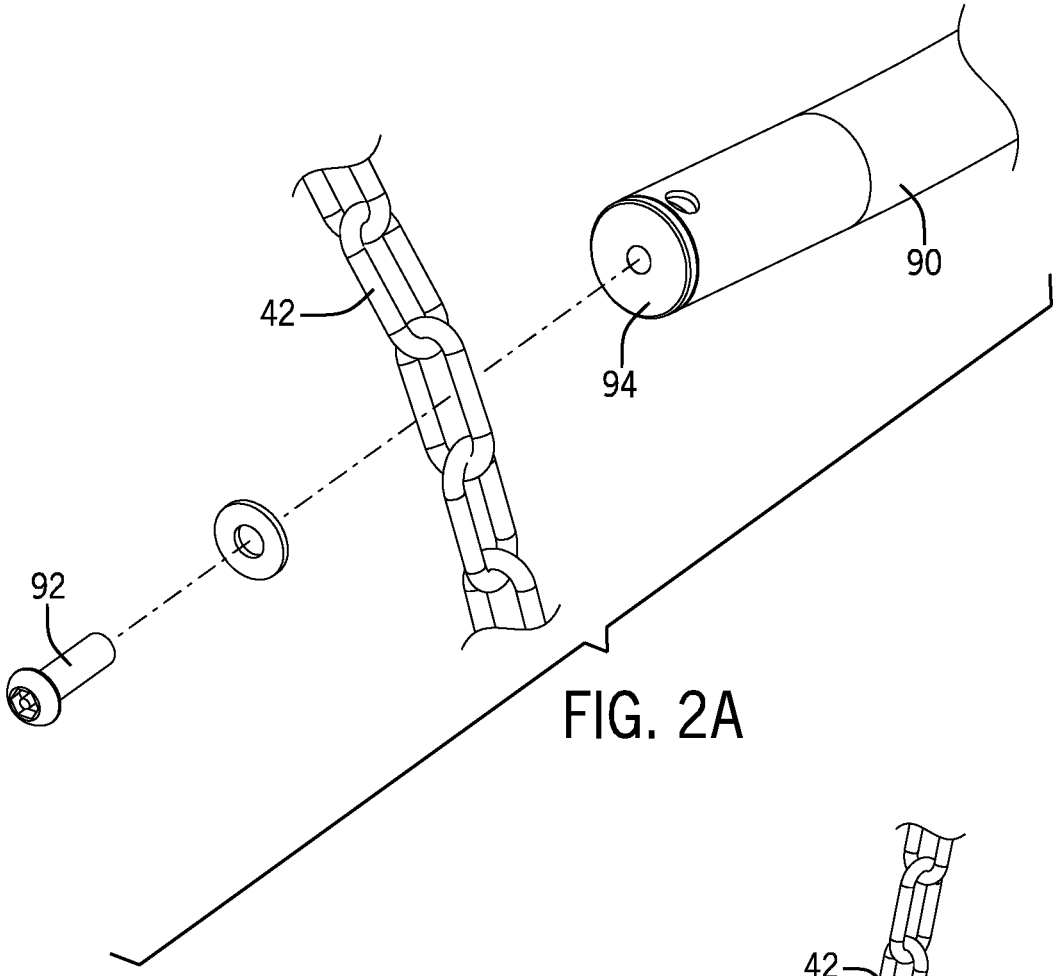
Figure 2B:
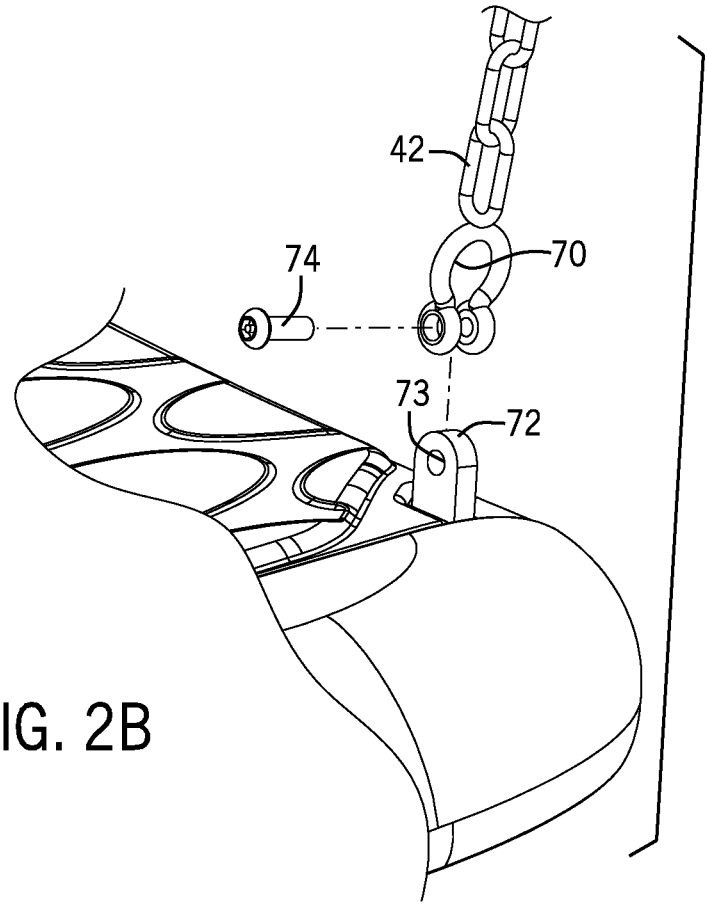

The bottom ends 62 of the glider swing chains 42*a*, 42*b*, 42*c*, 42*d* may be connected to corresponding chain attachments 72*a*, 72*b*, 72*c*, 72*d* by clevis shackles 70 receiving a lowermost chain of the glider swing chains 42 and further securing a clevis pin 74 extending through the clevis shackle 70 and the hole 73 of the chain attachments 72, as seen in FIG. 2B.

In one embodiment, the footboard 60 may be approximately 60.5 inches in length, 14⅜ inches in height, and 6 inches in depth. The length of the footboard 60 may be at least three times or at least four times the width of the footboard 60.

The glider swing 14 further includes a horizontally extending handlebar 90 coupled to the chains 42 and extending at a position above and substantially over the footboard 60. The handlebar 90 may extend along a longitudinal axis 96 substantially parallel to the longitudinal axis 58 of the footboard 60.

The handlebar 90 comprises left and right sidebars 98, 100 extending along the longitudinal axis 96 and arching toward one another to form a narrowed center portion 102. The left and right sidebars 98, 100 curve outwardly at outer ends 106 of the left and right sidebars 98, 100 to provide a space 108 therebetween that is generally wide enough to accommodate a width of an average user standing therebetween. In one embodiment, the left and right sidebars 98, 100 may be approximately 44 inches in length and approximately 6 inches in width. A length of the left and right sidebars 98, 100 may be substantially the same as a length of the footboard 60.

The left and right sidebars 98, 100 are joined at the narrowed center portion 102 by a pair of parallel spacers 104 connecting the left and right sidebars 98, 100 to one another. In one embodiment, the pair of parallel spacers 104 may be approximately 16 inches in length. A length of the pair of parallel spacers 104 may be substantially the same as a width of the footboard 60 at its center area.

The outer ends 106 of the left and right sidebars 98, 100 are attached to the corresponding chains 42, for example, the left sidebar 98 is attached to chains 42*a*, 42*b* and the right sidebar 100 is attached chains 42*c*, 42*d*. The outer ends 106 may be coupled to corresponding chains 42 by screws 92 extending through the chains 42 and secured into endcaps 94 of the left and right sidebars 98, 100, as seen in FIG. 2A.

The handlebar 90 extends at a height of an average user's waist when standing on the footboard 60, for example 2 to 3 feet above the footboard 60.

In use, one or more users may stand in the space 108 provided between the outer ends 106 of the left and right sidebars 98, 100 and inward of the front and rear ends 64, 66 of the footboard 60. The user may grasp the left and right sidebars 98, 100 or the pair of parallel spacers 104 in the center portion 102 as handgrips while swinging.

The user gains momentum of the glider swing 14 by shifting the footboard 60 and the handlebar 90 in opposite directions to propel a swinging or gliding motion. In this respect, the user may push or pull the handlebar 90 with their hands while shifting their weight on the footboard with their hips, legs, and feet. The swinging or gliding motion may move the glider swing 14 generally along axes 58, 96. In some situations, the swinging or gliding motion may move the glider swing 14 in a direction perpendicular to axes 58, 96 as desired by the user in a similar manner. It is understood that the flexibility of the chains 42 between the footboard 60 and handlebar 90 allow for the substantially rigid footboard 60 and substantially rigid handlebar 90 to be moved in opposite directions while the extension of the footboard 60 and handlebar 90 maintain a substantially parallel orientation, similar to a four bar linkage.

A transverse distance between the glider swing hangers 40*a*, 40*c*, and between the glider swing hangers 40*b* and 40*d*, respectively, is greater than a transverse distance between the chain attachments 72*a*, 72*c*, and between the chain attachments 72*b*, 72*d*, respectively of the footboard 60. A longitudinal distance between the glider swing hangers 40*a*, 40*b*, and the glider swing hangers 40*c*, 40*c*, respectively, is less than a longitudinal distance between the chain attachments 72*a*, 72*b* and between the chain attachments 72*c*, 72*d*, respectively, of the footboard 60. The spacing of glider swing hangers 40 with respect to corresponding chain attachments 72 permit the upper surface 69 of the footboard 60 to follow an upwardly concave arch so that the user(s) are stabilized on the upper surface 69 during swinging without tilting of the footboard 60 and without twisting of the chains 42. The spacing also encourages swinging along the longitudinal axis 58.

When one user is riding the glider swing 14 the user may stand on the upper surface 69, inwardly of either of the front and rear outer ends 64, 66 of the footboard 60 while leaning toward the opposite outer end 64, 66 to maintain balance. When more than one user, for example, two or more users, are riding the glider swing 14, the users may stand on the upper surface 69 on opposite ends of the footboard 60, inwardly of the front and rear outer ends 64, 66. The swinging motion of the footboard 60 and handlebar 90 may be coordinated between the two users.

Figure 4:
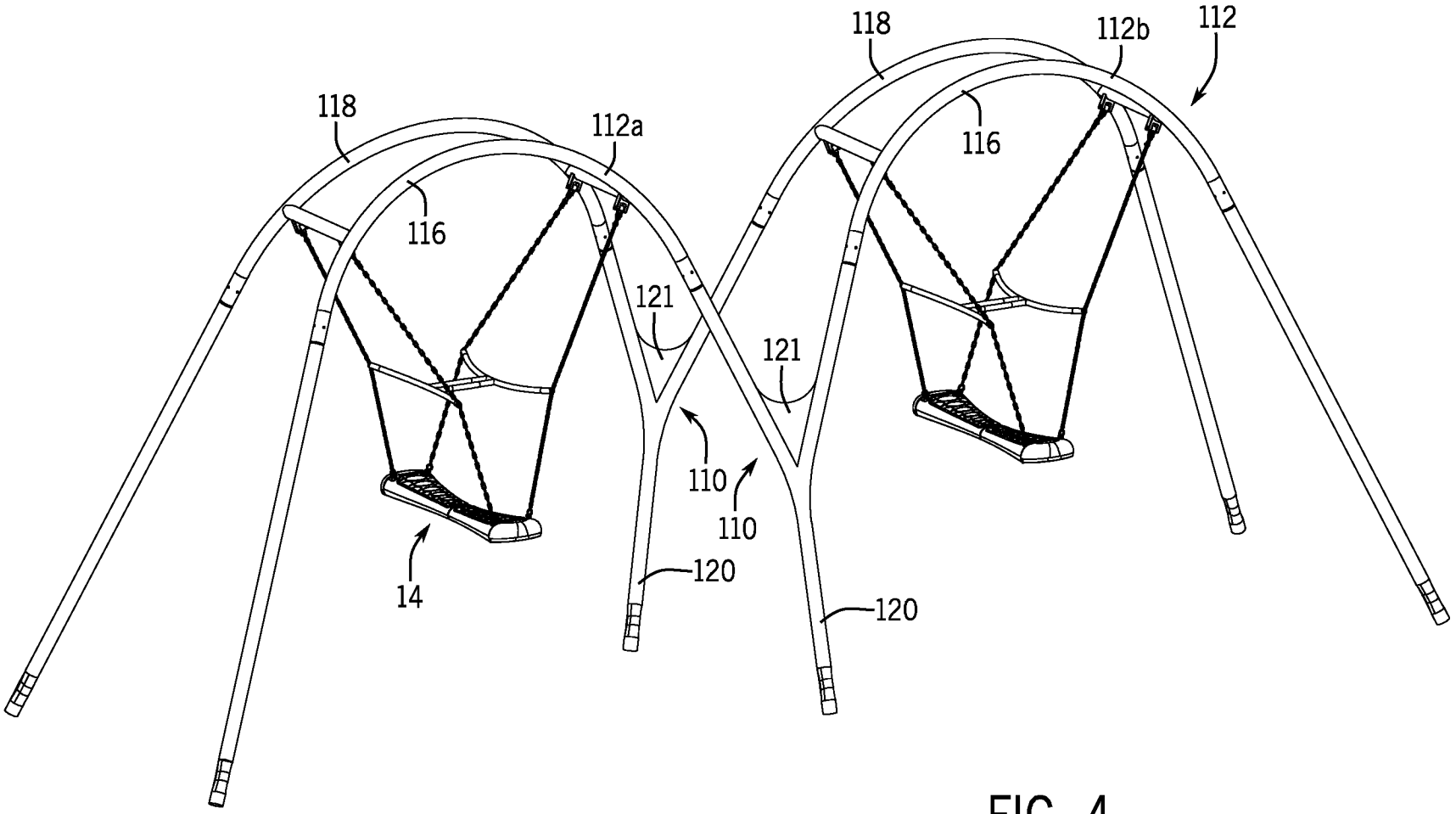
FIG. 4 is a perspective view of a standing playground glider swing assembly of a second embodiment of the present invention showing a glider swing frame having two bays and at least one bay supporting a glider swing at four attachment points.

Referring to FIG. 4, in an alternative embodiment, the standing playground glider swing assembly 10 may be a double bay glider swing frame 112*a*, 112*b* whereby at least one of the two bays provides attachment of the glider swing 14 as described above. In one embodiment, a first glider swing frame 112*a* may support the glider swing 14 while a second glider swing frame 112*b* may support a different type of swing as shown.

In the double bay glider swing frame 112*a*, 112*b*, the glider swing frame 12 described above may be essentially duplicated whereby each of the glider swing frames 112*a*, 112*b* share a vertically extending leg 120 of each of the front and rear arch 116, 118, respectively, at a right end of the glider swing frame 112*a* and a left end of the glider swing frame 112*b*.

The shared vertically extending leg 120 may be combined at a Y-shaped branch 110 whereby the upper ends of front arches 116 of the glider swing frames 112*a*, 112*b*, and the upper ends of the rear arches 118 of the glider swing frames 112*a*, 112*b*, respectively, converge to the common vertically extending leg 120. Reinforcement 121 may be provided at the Y-shaped branch 110 spanning between the upper ends of the front and rear arches 116, 118 to provide additional support therebetween.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What I claim is:

1. A glider swing assembly comprising:

a support frame adapted to support above a ground surface a first set of longitudinally spaced support frame pivot points laterally separated from a second set of longitudinally spaced support frame pivot points;

a platform having a length extending along a longitudinal axis and a width extending along a transverse axis, the platform providing on its upper surface a first set of longitudinally spaced platform pivot points laterally separated from a second set of longitudinally spaced platform pivot points;

a set of at least four flexible suspension members attached individually to each of the first and second set of longitudinally spaced support pivot points and connecting to a corresponding one of the first and second set of longitudinally spaced platform pivot points to suspend the platform above the ground to swing along the longitudinal axis; and a first and second longitudinal side bars extending along the longitudinal axis to connect to respective flexible suspension members of sets of longitudinally spaced pivot points, respectively, at a height between the support frame and the platform to provide handgrips for a user standing on the platform;

wherein the flexible suspension members allow the platform and the first and second longitudinal side bars, respectively, to move relative to each other in opposing directions to promote overall swinging motion of the entire assembly.

2. The glider swing assembly of claim 1 further including a transverse spacer bar extending between the first and second longitudinal side bars.

3. The glider swing assembly of claim 2 wherein the transverse spacer bar extends across center portions of the first and second longitudinal side bars to provide an H configuration.

4. The glider swing assembly of claim 2 wherein the first and second longitudinal side bars extend substantially a full length of the platform and the transverse spacer bar extends substantially a full width of the platform.

5. The glider swing assembly of claim 1 wherein the transverse separation of the first and second longitudinally spaced support pivot points is greater than a transverse separation of the first and second longitudinally spaced platform pivot points by at least three times.

6. The glider swing assembly of claim 1 wherein the longitudinal separation of the first and second longitudinally spaced support pivot points is less than the longitudinal separation of the first and second longitudinally spaced platform pivot points.

7. The glider swing assembly of claim 1 wherein the first and second longitudinal side bars are connected to the flexible suspension members at a height between 2 to 3 feet above the platform.

8. The glider swing assembly of claim 1 wherein the platform provides an oblong shaped board with a narrowed center.

9. The glider swing assembly of claim 1 wherein the length of the platform is greater than the width of the platform by at least three times.

10. The glider swing assembly of claim 1 wherein the flexible suspension members have a length to suspend the platform at rest at least 1 foot above the ground surface.

11. The glider swing assembly of claim 1 wherein the platform comprises a polymer shell reinforced by a metal frame extending along the longitudinal axis.

12. The glider swing assembly of claim 1 wherein the support frame provides two longitudinally separated arches extending transversely and joined by at least one longitudinally extending beam.

13. The glider swing assembly of claim 12 wherein the support frame pivot points provide a swivel that swivel the flexible suspension members in two perpendicular directions.

14. The glider swing assembly of claim 1 wherein the flexible suspension members are chains.

15. The glider swing assembly of claim 1 wherein the first and second longitudinal side bars arch inwardly toward each other to provide a space therebetween that is wider between their ends than between their centers and promoting natural grip angle.

16. A glider swing assembly comprising:

a support frame adapted to support above a ground surface a first set of longitudinally spaced support frame pivot points laterally separated from a second set of longitudinally spaced support frame pivot points;

a platform having a length extending along a longitudinal axis and a width extending along a transverse axis, the platform providing on its upper surface a first set of longitudinally spaced platform pivot points laterally separated from a second set of longitudinally spaced platform pivot points; and a set of at least four flexible suspension members attached individually to each of the first and second set of longitudinally spaced support pivot points and connecting to a corresponding one of the first and second set of longitudinally spaced platform pivot points to suspend the platform above the ground to swing along the longitudinal axis;

wherein the platform provides an oblong shaped board with broad surfaces at its outer longitudinal ends which narrow continuously toward a longitudinal center of the board;

wherein the length of the platform is greater than the width of the platform by at least three times and wherein the platform comprises a polymer shell reinforced by a metal frame extending along the longitudinal axis.

17. The glider swing assembly of claim 16 wherein the metal frame comprises at least one rod attached to a bottom surface of the platform.

18. The glider swing assembly of claim 17 wherein the bottom surface of the platform carries a recess configured to receive the metal frame.

19. The glider swing assembly of claim 16 wherein the platform has rounded edges and opposed ends of the length of the platform covered with an impact absorbing material.

20. A glider swing assembly comprising:

a support frame adapted to support above a ground surface a first set of longitudinally spaced support frame pivot points laterally separated from a second set of longitudinally spaced support frame pivot points;

a platform having a length extending along a longitudinal axis and a width extending along a transverse axis, the platform providing on its upper surface a first set of longitudinally spaced platform pivot points laterally separated from a second set of longitudinally spaced platform pivot points; and a set of at least four flexible suspension members attached individually to each of the first and second set of longitudinally spaced support pivot points and connecting to a corresponding one of the first and second set of longitudinally spaced platform pivot points to suspend the platform above the ground to swing along the longitudinal axis;

a first and second longitudinal side bars extending along the longitudinal axis to connect to respective flexible suspension members of sets of longitudinally spaced pivot points, respectively, at a height between the support frame and the platform to provide handgrips for a user standing on the platform;

wherein the length of the platform is greater than the width of the platform by at least three times and wherein the platform comprises a polymer shell reinforced by a metal frame extending along the longitudinal axis.

* * * * *